US006047421A

United States Patent [19]

Barone

[11] Patent Number: 6,047,421

[45] Date of Patent: Apr. 11, 2000

[54] NO-SEW UPHOLSTERY SYSTEM

[76] Inventor: Dana A. Barone, 700 Beaver Dam Rd., Point Pleasant, N.J. 08742

[21] Appl. No.: 09/060,445

[22] Filed: Apr. 15, 1998

Related U.S. Application Data

[60] Provisional application No. 60/041,000, Apr. 21, 1997.

[51] Int. Cl.[7] ..... A47C 31/02

[52] U.S. Cl. ..... 5/655.9; 5/640; 5/402; 5/280; 5/692

[58] Field of Search ..... 5/636, 640, 645, 5/402, 403, 405, 406, 407, 408, 280, 692, 655.6, 657, 655.9; 297/452.6, 218.1; 29/91, 91.1, 91.5

[56] References Cited

U.S. PATENT DOCUMENTS

| | | | |
|---|---|---|---|
| 2,501,133 | 3/1950 | Levy . | |
| 2,998,062 | 8/1961 | Bixby . | |
| 3,512,191 | 5/1970 | Wall et al. | 5/692 |
| 3,643,288 | 2/1972 | Olivari . | |
| 4,679,851 | 7/1987 | Solie et al. | 5/655.6 X |
| 4,776,636 | 10/1988 | Pyle et al. | 297/452.6 |
| 4,999,874 | 3/1991 | White . | |
| 5,033,525 | 7/1991 | Paeselt . | |
| 5,152,331 | 10/1992 | Barone . | |
| 5,361,821 | 11/1994 | Barone . | |
| 5,383,635 | 1/1995 | Barone . | |
| 5,505,245 | 4/1996 | Badalamenti . | |

FOREIGN PATENT DOCUMENTS

| | | | |
|---|---|---|---|
| 1158683 | 7/1969 | United Kingdom | 297/452.6 |

*Primary Examiner*—Michael F. Trettel
*Attorney, Agent, or Firm*—Connolly Bove Lodge & Hutz

[57] ABSTRACT

The no-sew upholstery system of the invention comprises a soft or semi-soft foam which is covered by fabric through a wrap and tuck process. The form incorporates an opening through an exterior surface. The fabric employed is wrapped around the form and its ends are tucked through the exterior opening. The form may also incorporate a pocket in the interior to provide additional area for accepting the fabric. Multiple fabric accents and devices for decoration and locking function may be selectively inserted into the opening. Because of the characteristics of the foam and the close-fit force exerted on the ends of fabric, the result is to provide a form which holds the fabric in place-yet, one which is easy to cover by the purchaser without the need for any sewing, gluing or stapling to give a customized look.

19 Claims, 2 Drawing Sheets

NO-SEW UPHOLSTERY SYSTEM

CROSS-REFERENCE TO RELATED APPLICATION

This application is based upon provisional application Ser. No. 60/041,000 filed Apr. 21, 1997, now expired.

FIELD OF THE INVENTION

This invention relates to styles for decorating or upholstering soft furnishings and, more particularly to upholstery styles for creating pillows, frames and fabric covered accessories. The invention may also be practiced for forming other ornamentations.

BACKGROUND OF THE INVENTION

As is well known and understood, upholstered goods and pillow stylings are typically manufactured by skilled professionals who either have "ready-made" styles mass produced in which case the cost is low and the selection is limited, or have "custom" styles attained through a designer on an individual basis, in which case the selection is unlimited but the costs are extremely high. Also, these upholstered items are fairly permanent due to the traditional fabricating processes involved. It would be advantageous, therefore, if a new and unique manufacture were available to make these applications more cost effective, and to provide a "custom look" easily and inexpensively with the additional advantage of being able to change the fabric or styling with little effort.

In my U.S. Pat. Nos. 5,152,331 and 5,383,635 I have disclosed various techniques for providing window treatment and fabric wrap tables and the like wherein the fabric is secured in a non-sew wrap and tuck process.

SUMMARY OF THE INVENTION

An object of this invention is to provide an upholstery system which uses a wrap and tuck process for securing a fabric in place thereby avoiding sewing.

A further object of this invention is to provide such a system which permits the fabric to be easily wrapped and tucked into place and to similarly be easily removed so that a different fabric could be secured when desired.

In accordance with this invention a soft or semi-soft foam base material is provided having an opening preferably centrally located on an external surface of the foam form. The fabric is wrapped around the foam form with the ends of the fabric tucked through the exterior opening. In a preferred optional practice of the invention the form also incorporates a pocket in the interior of the form generally perpendicular to and communicating with the opening to provide an additional area for accepting the fabric.

As will become clear in the description that follows, the upholstery system of the present invention accepts the same types of coverings as now available in the industry and allows for a multiplicity of designs by using different shapes with different style fabric applications. As will also be seen, the upholstery process will be easy to cover and decorate according to one's preference. As will also become clear from the description below, the upholstery process of the invention is reusable, allowing an easy change of fabric coverings and/or re-use of shapes and forms-all in an easy, fast and inexpensive manner. As will become apparent, the upholstery process of the invention can be easily accomplished by the consumer without the need for professional help.

More particularly, and as will be seen from the description below, the upholstery process of the invention follows from the use of a form of soft or semi-soft foam which is covered by fabric through a wrap and tuck process. The form utilized will be seen to incorporate an opening in the exterior surface and an optional pocket in the interior. The fabric employed will be seen to be wrapped around the form with its ends fitted through the opening and tucked between the layers of foam. Because of the characteristics of foam and with the opening being suited to accept the opposing ends of the fabric in a close fit, the end result is to provide a form which holds the fabric in place. And, because of these characteristics, the upholstered form can be accomplished without the need for any sewing, gluing or stapling whatsoever so as to provide a customized look easily and inexpensively. As will also be seen, by using the upholstery process of the invention, it then becomes possible to tuck additional fabric or trims though the opening to create different styles according to the preferences of the owner. Also, it will be seen that similarly, devices can be inserted into the opening to serve a function (such as to affix the upholstered item to other furnishings for decoration or cushioning). To provide for additional fabric multi-fabric decorations and certain devices, it will also be seen that the form may incorporate an additional pocket in the interior communicating with the opening.

THE DRAWINGS

DETAILED DESCRIPTION

Figure 1:
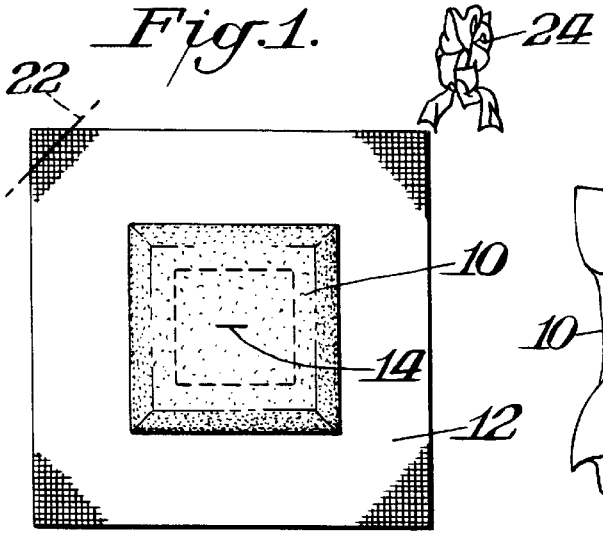
FIG. 1 is a top plan view showing a fabric and foam form for making a pillow in accordance with this invention.
Figure 2:
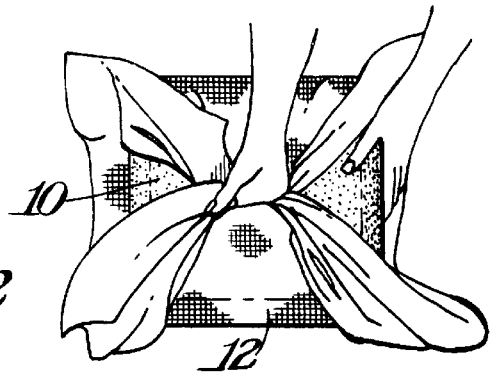
FIG. 2 is a top plan view similar to FIG. 1 showing the wrap and tuck process for securing the fabric to the foam form.

FIGS. 1–4 illustrate the components and steps used in the making of a pillow in accordance with this invention. As shown therein a foam form 10 is provided which will be wrapped by fabric 12. Foam form 10 is preferably made of a soft or semi-soft material of predetermined shape and dimension. An opening 14 is formed generally centrally through the exterior surface 18 on one side of form 12. As illustrated in FIG. 1 the opening 14 is a slit made in the foam. The opening, however, could be of larger size where opposing sides of the opening are spaced from each other thereby permitting a greater amount of material to be tucked into the opening or to obtain a desired decorative effect such as to accommodate a fabric styling, as later described. Foam form 10 has sufficient resiliency to tend to return to its original condition after the fabric 12 has been tucked into the opening 14, as illustrated in FIG. 2, so as to firmly hold the fabric in place. Any suitable material may be used which will accomplish the desired results. For example, a polyurethane foam may be used having a density of between 1.0 and 2.0, and preferably between 1.3 and 1.8 pounds per cubic foot and able to withstand a compressive force of between 1 to 10 psi.

Figure 4:
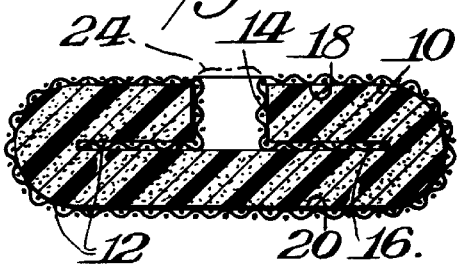
FIG. 4 is a cross-sectional view taken through FIG. 3 along the line 4—4.

The opening 14 is formed to extend from the outer surface 18 of foam form 10 and into the foam form a sufficient distance to permit the fabric 12 to be tucked into the opening. In a preferred practice of this invention, as illustrated in FIG. 4, a pocket 16 is formed internally in foam form 10. Pocket 16 communicates with opening 14 and preferably extends generally perpendicularly to opening 14. Preferably pocket 16 is located centrally between the opposing external surfaces 18,20 of foam form 10. Thus, opening 14 is initially formed through surface 18 and penetrates foam form 10 to a sufficient distance which may be midway between surfaces 18 and 20. Pocket 16 could be formed in any manner and would also comprise an opening which could extend from being a tight slit to a wider slot or opening having spaced surfaces. The shape and dimensioning of both opening 14 and pocket 16 would depend upon how much of fabric 12 is intended to be tucked first through opening 14 and then into pocket 16 or what type of decorative effect is desired. Although the pocket is not necessary for the broad practice of this invention, the pocket is preferable to provide an additional area for the insertion of fabric 12. Further, by wrapping the fabric 12 around the complete outer surfaces of foam form 10 and then perpendicularly into opening 14 and then again perpendicularly into pocket 16 there is an effective wrapping which in combination with the foam material assures a positive mounting of the fabric around the foam form.

The wrap and tuck technique could involve (as shown in FIGS. 2 and 4) a wrapping of the fabric 12 around the foam form 10 starting with lower external surface 20 and then around the sides of foam form 10 over to external surface 18 such that the ends or peripheral edges of the fabric 12 are inserted down into the exterior opening 14 and then into pocket 16. While as shown in FIG. 2 this can easily be done by hand, the use of an elongated instrument can be utilized in the same fashion. The provision of the pocket 16 in the interior of the foam form 10 creates additional area for employing fabric, which is important for certain decorative forms which would require greater quantities of fabric wrapping. By employing the soft or semi-soft foam, the fabric 12 is held in place secured against the shape of the foam form 10 and held there especially when the opening 14 accepts the opposing ends of the fabric in a close fit. As will be appreciated such process requires no sewing, gluing or stapling to hold the fabric in place and can be easily disassembled to change fabric coverings should such be desired at a later time.

FIG. 1 illustrates the fabric 12 to be of a square shape when used with the generally square shaped foam form 10. While having the shapes correspond to each other is preferred, the invention may be practiced with differing shapes. Similarly, even where the generally same shape is used the specific fabric shape may be altered such as by cutting the corners as indicated at the cut line 22 of FIG. 1.

If desired, the ornamentation could be enhanced by adding other forms of ornaments into the opening 14 after the fabric 12 has been completely wrapped and tucked. FIG. 1, for example, illustrates a knotted retainer 24 which is shown in phantom in FIG. 4 and is shown in solid in FIG. 3. Knotted retainer 24 would be pushed into opening 14 after the tuck and wrap procedure of fabric 12 has been completed. Where retainer 24 is knotted the two resulting free ends would be tucked into pocket 16 in opposite direction. Retainer 24 could take various forms such as having a rigid base to which a decoration such as the decorative fabric would be secured and the rigid base could be inserted into the pocket 16. Such practice could be particularly done where the opening 14 is of large enough size to readily permit the rigid base of the retainer 24 to pass through opening 14 and then be inserted into pocket 16. The retainer would add further ornamentation to the finished object such as a pillow while additionally functioning to further maintain the fabric 12 within the opening 14 and pocket 16.

An advantage of the present invention is thus that it lends itself to accepting an additional fabric styling or retainer 24 which could be created from fabric which has been knotted or tied in a bow or knotted on back and wrapped or twisted and tucked etc. The provision of this additional fabric styling or retainer 24 creates the possibility for a multiplicity of designs according to the preference of the owner. Where the invention would be sold to consumers for making their own pillows or other objects a plurality of fabric stylings 24 could be provided in a kit which would include the foam form and a how-to-style book.

Figure 3:
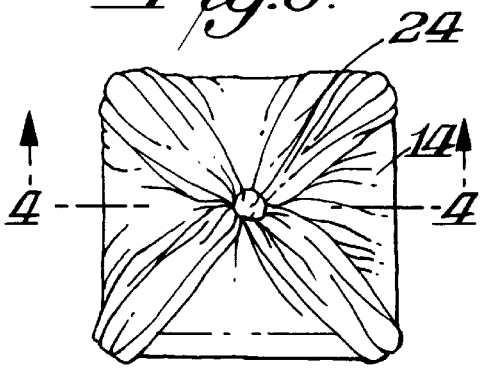
FIG. 3 is a top plan view similar to FIGS. 1 and 2 showing the finished pillow in accordance with this invention.
Figure 5:
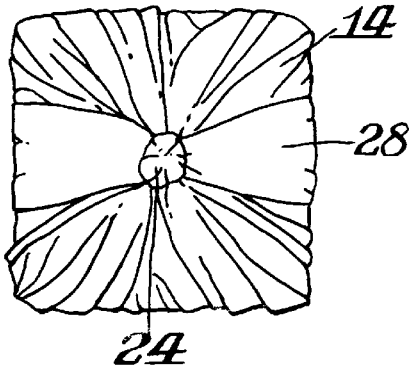
FIG. 5 is a view similar to FIG. 4 showing a variation in the decorative pillow design.

FIG. 3 illustrates one form of ornamental design resulting from the practice of this invention. FIG. 5 shows that by other manipulations of fabric 12, alternative decorative designs could result. In the embodiment of FIG. 5 an additional fabric strip 28 is tucked into the opening.

While FIGS. 1–5 illustrate the practice of the invention for making a pillow which is of generally square shape, it is to be understood that other types of shapes may be used such as circular, rectangular, cylindrical, spherical, triangular or any free form shape. With all of these shapes the same technique would be used wherein an opening would be formed in an external surface preferably, generally centrally of that surface in the foam form. The opening would extend from the external surface into the interior of the foam form a sufficient amount to permit the fabric to be wrapped around the foam form and tucked into the opening. If desired, in accordance with the amount of fabric to be tucked, the opening could be of a size and shape where the side walls are spaced from each other and, if desired, a pocket could be provided within the foam form communicating with the opening so that the fabric could be tucked through the opening and then into the pocket. The pocket could extend at any angular orientation with respect to the opening, but preferably is perpendicular and is located midway between opposite external surfaces of the foam form. Preferably pocket 16 extends completely around opening 14, although pocket 16 could be one or more slits/slots radiating from opening 14.

Figure 7:
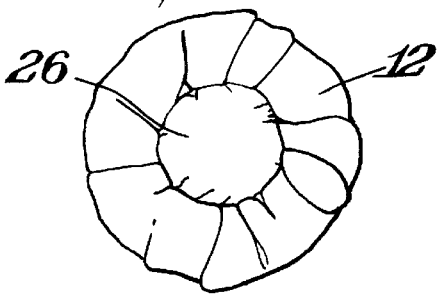
FIG. 7 is a top plan view of the pillow shown in FIG. 6.
Figure 6:
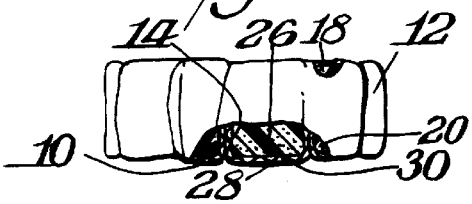
FIG. 6 is a side elevational view partly broken away showing a swag holder or ornament in accordance with this invention.

FIGS. 6–7 show a variation of the invention wherein the opening 14 is formed by removing a plug 26 of the foam form 10. In this practice of the invention the opening 14 extends completely through the foam form from one external surface 18 to the other 20. The wrap and tuck procedure could be practiced in various ways. For example, the fabric 12 would be wrapped around foam form 10 so that the fabric completely covers one end of the opening on, for example, the surface 18 with the edges of the fabric tucked into the opening from its surface 20. An additional fabric 28 would be wrapped around the surface 30 of plug 26 which would be in line with surface 20 of foam form 10 with the fabric then extending along the sides of the plug 26. Plug 26 would then be pushed back into opening 14 to retain the fabric 12 in its wrapped and tucked condition around foam form 10. The fabric 28 could be the same as or of a different fabric than fabric 12 depending on the intended design.

Alternatively, the foam form 10 could be placed against the fabric 12 on one side of the foam form such as side 20. The plug 26 could then be pushed into the opening 14 against the fabric thereby pushing the fabric 12 through the opening 14 until the fabric which is initially on side 20 covers the foam plug 26 and is located on opposite sides 18 to hold the tucked fabric within hole 14. The fabric edges are then wrapped around the foam form and tucked into the circular slit created by plug 26. An additional fabric could then be placed against the exposed portion of plug 26 to cover the plug. Such additional fabric may be of the same type or different type fabric as the base fabric 12.

In the embodiment illustrated in FIGS. 6–7 the cover foam is thus of generally donut shape with the hole of the donut being closed by the plug 26. The same fabric mounting techniques, however, with the use of plugs may be practiced with other shapes.

In the practice of the invention shown in FIGS. 6–7 a pocket is not illustrated but could be provided to accommodate, for example, the free edges of fabric 12 as it is tucked into enlarged cylindrical opening 14.

The embodiment illustrated in FIGS. 6–7 could function as a swag holder by inserting a mounting screw in the slit or opening 14 between plug 26 and the adjacent portion of foam form 10 at hole 14. Alternatively, the embodiment of FIGS. 6–7 could be a hanging ornament by inserting a hook into the top of the foam form so that the covered foam form could then be hung.

The pocket 16 can be formed in any suitable manner such as by slitting the foam form laterally from opening 14. Alternatively, the foam form itself could be made in two halves which are then glued together from their outer edges peripherally inwardly leaving an unglued central area which extends to the opening 14. The unglued area would thus form the pocket. Where it might be desired to have the pocket of greater volume, portions of the foam could be removed from the unglued area prior to securing the two foam form halves together.

Figure 8:
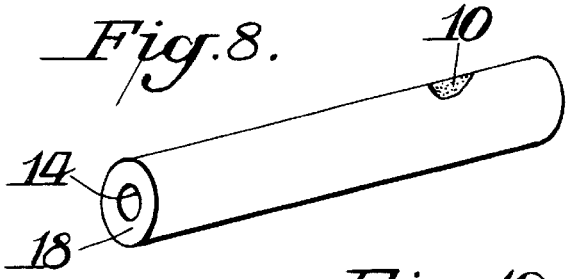
FIG. 8 is a perspective view of a foam form which would be used for making a bolster in accordance with this invention.

FIG. 8 illustrates a foam form 10 of generally cylindrical shape with a circular slit or enlarged opening 14. The opening 14 could be of a sufficient size that there is a spacing between opposite surfaces to accept a large amount of fabric. Alternatively, a narrow slit for opening 14 may be sufficient. The opening 14 could extend from only one surface 18 of foam form 10 and terminate a fixed distance within the foam form. Alternatively, a second opening could be provided on the opposite face of foam form 10 or a single opening could extend completely through the foam form. Because of the size of opening 14 a decoration such as retainer 24 could be inserted into the opening 14 particularly where there is an opening at each opposed side of foam form 10 to result in a decorative bolster.

Figure 9:
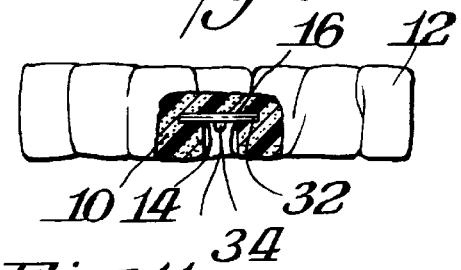
FIG. 9 is a side elevational view partly broken away of a chair cushion in accordance with this invention.

FIG. 9 illustrates the practice of the invention for forming a chair cushion. As shown therein after the fabric 12 has been tucked and wrapped around foam form 10 into opening 14 and pocket 16, a rigid member 32 is inserted into the pocket. Rigid member 32 could be a rod as illustrated or could be a flat plate or any other type of member having sufficient rigidity to be inserted in and then held within pocket 16 and thus firmly anchored in place. A cord 34 is attached to the member 32. The cord could be used for securing, for example, to tie the cushion to the frame or legs of a chair. Alternatively, a retainer such as retainer 24 could be inserted into the opening 14 and be in the form of a decorative button whereby the "cushion" is more of a decorative pillow.

Figure 10:
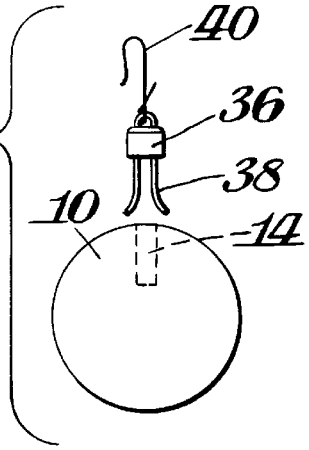
FIG. 10 is an exploded view of a hanging ornament in accordance with this invention.

FIG. 10 shows the practice of the invention for forming a hanging ornament. As shown therein, the foam form 10 is of spherical shape and includes an opening 14 so that the fabric could be wrapped around the spherical foam form 10 and could be tucked into opening 14. When used as a hanging ornament a connector 36 having spring arms 38 would be inserted into opening 14 and retained in place by the spring arms 38. Connector 36 would also function as a retainer similar to retainer 24. A clip 40 would be provided for hanging the ornament, such as to a Christmas tree.

Alternatively, the ornament of FIG. 10 could have shapes other than spherical shape. Similarly, the connector 36 could be a fabric loop tucked into the opening 14 and sufficiently held in place so that the loop would permit the ornament to be hung. The type of arrangement shown in FIG. 10 could also be used as a swag holder with various shapes for the foam form.

Figure 11:
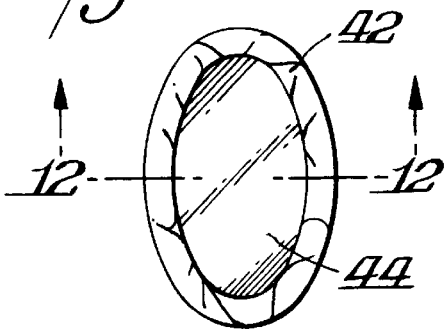
FIG. 11 is a front elevational view of a mirror or picture having its frame made in accordance with this invention.
Figure 12:
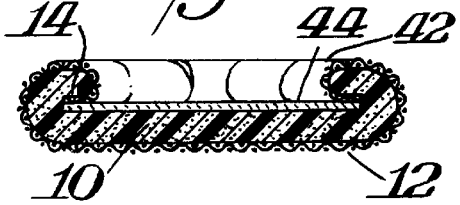
FIG. 12 is a cross-sectional view taken through FIG. 11 along the lines 12—12.

FIGS. 11–12 illustrate the practice of the invention for forming a decorative border 42 around a picture or mirror 44. As shown therein the opening 14 would be very large so as to accommodate an appropriately sized picture or mirror 44. The edges of the picture or mirror would extend into the pocket communicating with opening 14. The picture or mirror would thus function not only for its primary purpose of being a picture or mirror, but would also act as a retainer to maintain the fabric tucked into and held within the opening and pocket. Where the embodiment of FIGS. 11–12 is used for framing a picture, the picture is not only a retainer but is also a decorative retainer.

Although FIGS. 11–12 illustrate the foam form to be of arcuate shape in the preferred practice of the invention a square or rectangular shape would be used to facilitate the wrap and tuck process.

Figure 13:
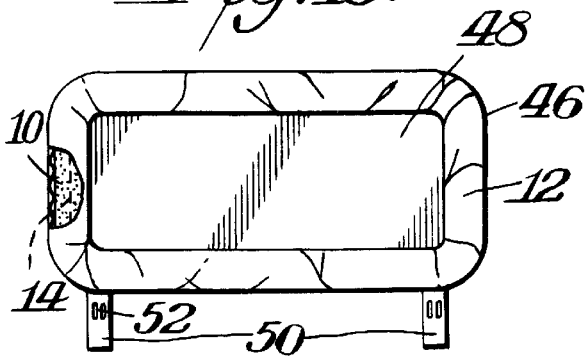
FIG. 13 is a front elevational view of a head board having a border or frame made in accordance with this invention.

FIG. 13 shows an arrangement similar to FIGS. 11–12, but where the invention is used for upholstering the frame 46 of a headboard. The fabric 12 would be wrapped around the free form 10 in the manner described with respect to FIGS. 11–12. The central portion 48 which is being framed, however, would be the headboard. Portion 48 would be of any suitable headboard material such as a laminate, foam core, wood, plastic, mirror, etc. The headboard could be provided with a pair of legs 50 having slots 52 for securement to a support such as a bed or the like. Alternatively, the headboard could be mounted by hanging the head board from a wall in which case legs 50 would not be necessary.

As should be apparent, the invention may be practiced for framing objects other than a picture or mirror or a headboard. A preferred characteristic of the member 44 or 48 being framed is that the member is of a rigid material which will effectively retain the fabric tucked into the pocket.

The invention may also be practiced where instead of having a single slit to accommodate the entire fabric being wrapped around the foam core and then tucked into the slit, a plurality of slits could be used and/or a plurality of different fabrics. For example, an individual fabric could be wrapped around a portion of the foam form and then tucked into opening 14, with a second adjacent fabric wrapped and tucked, etc. until the entire or a sufficient amount of the foam form is covered. The invention could also be broadly practiced by having a plurality of slits to accommodate individual fabrics each of which would be wrapped around a portion of the foam form and tucked into a pair of slits or a single fabric could be wrapped around the form foam and a decorative effect achieved by tucking portions of the fabric into plural slits. Where plural slits are used it is preferable that the slits are elongated parallel slits.

In general, the wrap and tuck process thus involves providing a fabric which is of sufficient size to completely envelope the foam form. The foam form is placed on the fabric with the side of the foam form remote from the opening being placed directly on the fabric. The fabric is then wrapped around the foam form so that the edges of the fabric are all located on the side of the foam form having the opening. The edges of the fabric are then tucked into the opening and held in place. The maintaining of the fabric in this wrapped and tucked condition is achieved by the resilient nature of the foam form and/or by an additional pocket communicating with the opening and/or by the insertion of a retainer into the opening. Where the opening extends completely through the foam form either of the surfaces from which the opening extends could be used for the tucking. In such practices the peripheral edges of the fabric are thus tucked into and locked in the opening to effectively cover the foam form.

What is claimed is:

1. A no-sew upholstery system comprising a foam form made of a soft or semi-soft foam material having resiliency, said foam form having a plurality of exterior surfaces, an opening extending into said foam form from one of said exterior surfaces, a preformed pocket within said foam form communicating with and at an angle to said opening to create a change in direction from said opening to said pocket, a fabric of sufficient size to envelope said foam form, said fabric having peripheral edges, said fabric being disposed against an exterior surface of said free form opposite said one exterior surface having said opening, said fabric being wrapped around said free form with said peripheral edges disposed at said one exterior surface, and said peripheral edges being tucked into said opening and then into said pocket to be locked in said opening.

2. The system of claim 1 wherein said pocket extends generally perpendicularly outwardly from and completely around said opening.

3. The system of claim 2 wherein said opening is a slit.

4. The system of claim 2 wherein said opening has side surfaces spaced from each other.

5. The system of claim 2 wherein said foam form comprises two half sections secured together peripherally inwardly with internal portions of said half sections being unsecured to form said pocket.

6. The system of claim 2 including a retainer inserted into said opening.

7. The system of claim 6 wherein said retainer is a plug made of said foam material and inserted into and filling said opening, and additional fabric being wrapped around said plug.

8. The system of claim 6 wherein said retainer is a decorative fabric styling detachably mounted in said opening.

9. The system of claim 6 wherein said wrapped free form comprises a pillow.

10. The system of claim 6 wherein said retainer is a rigid member.

11. The system of claim 10 wherein said rigid member is inserted into said pocket, and a cord connected to said rigid member and extending outwardly from said opening.

12. The system of claim 10 wherein said rigid member is a mirror, and said foam form comprises a frame around said mirror.

13. The system of claim 10 wherein said rigid member is a picture, and said foam form comprises a frame around said picture.

14. The system of claim 10 wherein said rigid member is a headboard, and said foam form comprises a frame around said headboard.

15. The system of claim 14 wherein said headboard includes structure for attachment of said headboard to a support.

16. The system of claim 1 wherein a connector is inserted into said opening, and hanging structure mounted to said connector whereby said foam form comprises a hanging ornament.

17. The system of claim 1 wherein said opening extends completely through said foam form from said one exterior surface to an opposite exterior surface, said opening being created by removing a plug from said foam form, and said opening being closed by said plug with additional fabric wrapped around said plug.

18. The system of claim 1 wherein a decorative retainer is inserted into said opening, and said foam form may comprise a pillow, or frame, or cushion or bolster.

19. A method of forming a no-sew upholstery system comprising providing a foam form made of resilient foam material with an opening extending from one external surface of the foam form inwardly into the foam form and with a preformed pocket within the foam form communicating with and at an angle to the opening, placing an opposite external surface of the foam form against a fabric, wrapping the fabric completely around the foam form, and tucking the ends of the fabric into the opening, continuing the tucking of the fabric from the opening to the pocket with a change in direction of the tucking from the opening to the pocket to lock the fabric in place in its wrapped condition around the foam form.

* * * * *